United States Patent [19]

Ichinose

[11] 4,397,563

[45] Aug. 9, 1983

[54] POWER CIRCUIT FOR ELECTRONIC WRISTWATCH

[75] Inventor: Matsuo Ichinose, Suwa, Japan

[73] Assignee: Kabushiki Kaisha Suwa Seikosha, Tokyo, Japan

[21] Appl. No.: 145,568

[22] Filed: May 1, 1980

Related U.S. Application Data

[63] Continuation-in-part of Ser. No. 852,873, Nov. 18, 1977, abandoned.

[30] Foreign Application Priority Data

Nov. 18, 1976 [JP] Japan ..... 51-138783

[51] Int. Cl.[3] ..... G04B 1/00; G04B 37/00

[52] U.S. Cl. ..... 368/204; 323/281

[58] Field of Search ..... 368/66, 85–87, 368/155, 203–205, 217–219; 323/281, 282; 307/273, 290, 297, 350, 355

[56] References Cited

U.S. PATENT DOCUMENTS

| | | | |
|---|---|---|---|
| 3,743,923 | 7/1973 | Steudel | 323/281 |
| 3,993,985 | 11/1976 | Citopard et al. | 368/66 |
| 3,996,482 | 12/1976 | Lockwood | 307/273 |
| 3,999,368 | 12/1976 | Yoshida | 368/204 |
| 4,094,137 | 6/1978 | Morokawa | 368/204 X |
| 4,232,261 | 11/1980 | Lingstaedt et al. | 323/281 |
| 4,258,310 | 3/1981 | Asakawa et al. | 323/281 |

*Primary Examiner*—Vit W. Miska

*Attorney, Agent, or Firm*—Blum, Kaplan, Friedman, Silberman & Beran

[57] ABSTRACT

A power circuit for an electronic wristwatch is provided wherein voltage reduction circuit means is positioned intermediate a battery source and at least a portion of the circuitry of the timepiece to be driven by the battery source. The battery source is preferably a lithium battery. The voltage reduction circuit means include a capacitor and other circuit components formed on an integrated circuit substrate.

14 Claims, 17 Drawing Figures

POWER CIRCUIT FOR ELECTRONIC WRISTWATCH

This application is a continuation-in-part of application Ser. No. 852,873, filed Nov. 18, 1977 for Power Circuit For Electronic Wristwatch, now abandoned.

BACKGROUND OF THE INVENTION

This invention relates generally to battery driven electronic wristwatches. In the art, electronic wristwatches are generally provided with a crystal vibrator, the natural oscillation frequency of the vibrator providing a time standard signal. The time standard signal is converted into suitable timekeeping signals through the use of an C-MOS (complimentary coupled metal oxide semiconductor) integrated circuit including a divider circuit, a counter circuit, a decoder circuit, a driver circuit and other related circuitry. The timekeeping signals are generally applied to a display device such as a liquid crystal display to provide a visual time indication. In the art, the battery generally utilized is a silver battery having a voltage range from 1.4 volts to 1.6 volts. Such silver batteries have a capacity in the range of 100 milliampere-hours to 150 milliampere-hours and a life of between two and three years. However, in recent years, watch designers have demanded the utilization of this batteries to increase the aesthetic appeal of the watch and have further demanded increased battery life to increase the utility of the electronic wristwatches. In order to meet these demands, several approaches have been proposed including the use of solar batteries to supplement the permanent battery to reduce the drain on the permanent battery, and the use of high density batteries such as the lithium battery. However, although the lithium battery has several times as much capacity as a conventional silver battery, the lithium battery has a disadvantage in that its power consumption is twice as large as that of a silver battery operating the same circuitry. This results because the voltage output of a lithium battery is about 2.8 volts.

What is needed is an electronic timepiece capable of using a high voltage battery such as a lithium battery without excessive power consumption.

SUMMARY OF THE INVENTION

Generally speaking, in accordance with the invention, a power circuit for an electronic wristwatch especially suitable for use with a high voltage battery and having low power consumption is provided. In addition to battery means, the electronic wristwatch includes timekeeping circuit means coupled to the battery for powering and adapted to produce timekeeping signals, display means coupled to said timekeeping circuit means for the display of time in response to said timekeeping signals, and voltage reducing means connected intermediate said battery means and at least a portion of the circuit elements of said timekeeping circuit means for reducing the voltage delivered to the circuit elements to a level below the output voltage of the battery means. The battery means may be a lithium battery. A capacitor delivers electrical energy to the timepiece circuitry and to the voltage reducing means, all of which are formed on an integrated circuit substrate. All of the circuit elements of the timekeeping circuits may be coupled to the battery means through the voltage reducing circuits or a portion of the timepiece circuit elements may be coupled directly to the battery. By providing a suitable voltage reduction circuit intermediate a high voltage battery, for example, lithium, and selected timekeeping circuitry, the disadvantages of a high voltage battery are avoided.

Accordingly, it is an object of this invention to provide an improved power circuit for an electronic wristwatch characterized by extremely long battery life.

Another object of this invention is to provide an improved power circuit for an electronic wristwatch which is adapted to efficiently use a lithium battery.

Still another object of this invention is to provide an improved power circuit for an electronic wristwatch which maximizes the beneficial effects of incorporating relatively high voltage batteries.

A further object of this invention is to provide an improved power circuit for an electronic wristwatch which is substantially formed on the same substrate as the other circuits for the wristwatch.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
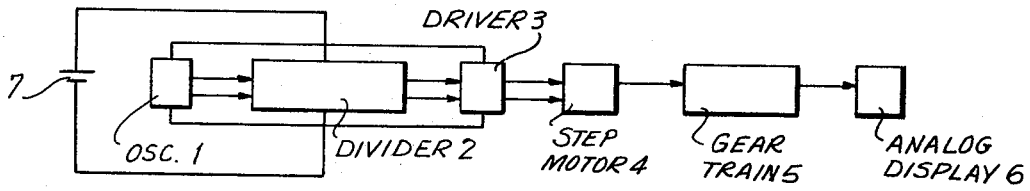
FIG. 1 PRIOR ART
FIG. 1 is a functional block diagram of one embodiment of a prior art electronic wristwatch incorporating an analog display.

Referring now to FIG. 1, the prior art electronic wristwatch depicted includes an oscillator circuit 1, for example, including a quartz crystal vibrator, which produces time standard signals. The time standard signals from the oscillator 1 are divided down in a divider network 2 into lower frequency signals for application to a driver circuit 3. The driver circuit 3 produces timekeeping signals which are applied to a step motor 4 which, in turn, drives a gear train 5. The gear train 5 drives a conventional analogue display 6 including hands (not shown). A battery 7, which in a conventional prior art construction would be a silver battery, drives the electronic timepiece. The output of a silver battery is about 1.4 to 1.6 volts which is applied to the oscillator circuit 1, divider network 2 and driver circuit 3. Step motor 4 is generally driven once per second by the timekeeping circuit output of the driver circuit 3. Assuming as a reasonable example, that the current drain in the oscillator 1, divider network 2, and driving circuit 3 is 3 microamperes, the current drain for the step motor 4 is also 3 microamperes, then the total current drain of the timepiece is 6 microamperes. Under those conditions the life of the battery 7 is approximately two years when using a silver battery having a capacity of approximately 100 milliampere-hours.

When the battery 7 of FIG. 1 is a lithium battery, the output voltage of the battery is approximately 2.8 volts to 3.0 volts. However, even when the capacity of the lithium battery is three times that of the silver battery, power consumption is still twice as large as the power consumption when the circuit is driven by a silver battery. As a result the life expectancy of the lithium battery is only about 1.5 times as great as the life of the silver battery, assuming essentially identical circuit construction. This less than expected increase in battery life results from the fact that current consumption of an integrated circuit increases when the circuit is driven at higher voltages. Accordingly, although the lithium battery has several times as much capacity as that of the silver battery, only a minimal beneficial effect is produced when the lithium battery, which has a relatively high voltage as compared to the silver battery, is applied to a conventional electronic wristwatch circuit of the prior art.

Figure 2:
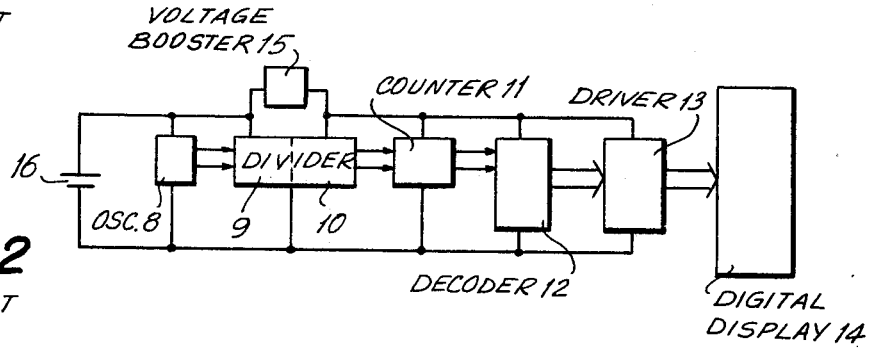
FIG. 2 PRIOR ART
FIG. 2 is a block diagram of a second embodiment of a prior art electronic wristwatch having a digital display.

With reference to FIG. 2, the depicted prior art digital electronic watch includes an oscillator circuit 8 having therein, for example, a vibrator of quartz crystal, vibrating at a natural frequency to produce a timekeeping standard signal. The circuit also includes a divider network 9, 10 for dividing down the frequency of the standard timing signals from the oscillator 8 to a relatively low frequency signal, a counter circuit 11 for producing timekeeping signals in response to said relatively low frequency signal output from said divider network 9, 10, a decoder circuit 12 for decoding the timekeeping signals from the counter 11 and converting the timekeeping signals into proper format for driving a display 14 by means of a driver circuit 13. The display 14 is a digital display comprised, for example, of a liquid crystal or the like. The timepiece is driven by a battery 16, in this embodiment a silver battery having an output voltage of 1.4 volts to 1.6 volts. This voltage is applied directly to the oscillator circuit 8 and to the early or higher frequency divider stages 9 of the divider network 9, 10. The output voltage of battery 16 is boosted by a suitable booster circuit 15 to a level of about 2.8 volts to 3.2 volts. This boosted voltage is applied to the lower frequency divider stages 10 of the divider network 9, 10, and also to the counter 11, decoder 12 and driver 13. In a typical timepiece of the prior art, the current drain in the oscillator circuit 8 and the divider network 9 is 3 microamperes when these circuits are driven with a voltage of approximately 1.5 volts. The current drain for other circuits of the timepiece which are driven with a voltage of approximately 3.0 volts is in the order of 0.5 microamperes. When considering the total current drain and the effect of the booster circuit 15, the total current drain from the battery 16 amounts to approximately 6 microamperes. The lifetime of a silver battery having a capacity of 100 milliampere-hours is thus about two years.

Figure 3:
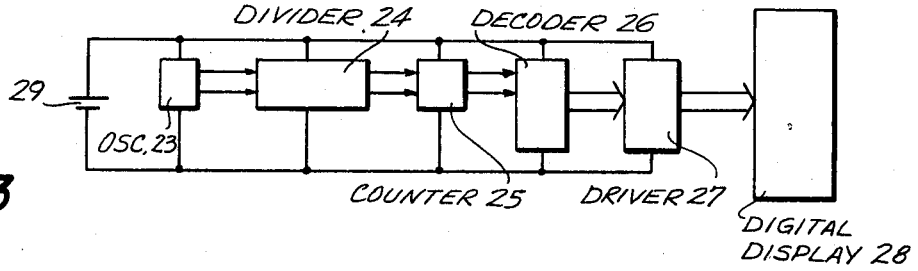
FIG. 3 is a functional block diagram of a third embodiment of a prior art electronic wristwatch incorporating a digital display.

FIG. 3 depicts another prior art digital timepiece but powered by a lithium battery 29. The timepiece includes an oscillator 23, divider network 24, counter 25, decoder 26, driver 27 and display 28 performing substantially the same functions as described for the embodiment of FIG. 2. All of these circuit elements are driven directly from the output of the battery 29. Because the output voltage of the lithium battery 29 is approximately 2.8 volts to 3.0 volts, the power consumption for the circuit of FIG. 3 is about twice that of the circuit of FIG. 2, assuming that the circuit elements are similar in both circuits. The circuit of FIG. 3 is characterized by a current drain from the battery of substantially more than 6 microamperes. Accordingly, when a lithium battery is applied to an electronic timepiece circuit of the type of FIG. 3, power is more wastefully consumed than where the same circuit is driven by a more conventional silver battery.

Electronic timepieces in accordance with this invention, improve the battery life by applying a reduced battery voltage to a part or all of the electronic circuits of the timepiece. Further the battery is smaller and thinner which improves the appearance of the timepiece.

Figure 4:
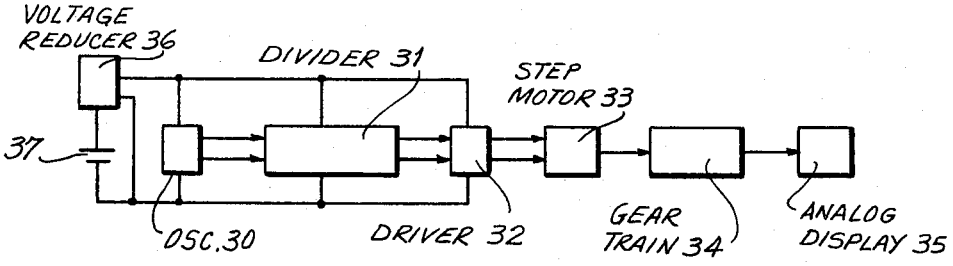
FIGS. 4–7 are functional block diagrams of embodiments of electronic wristwatches in accordance with the invention.
Figure 5:
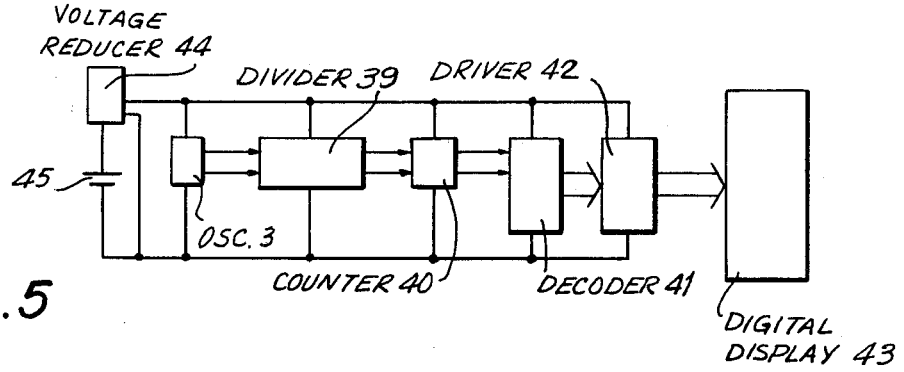
Figure 6:
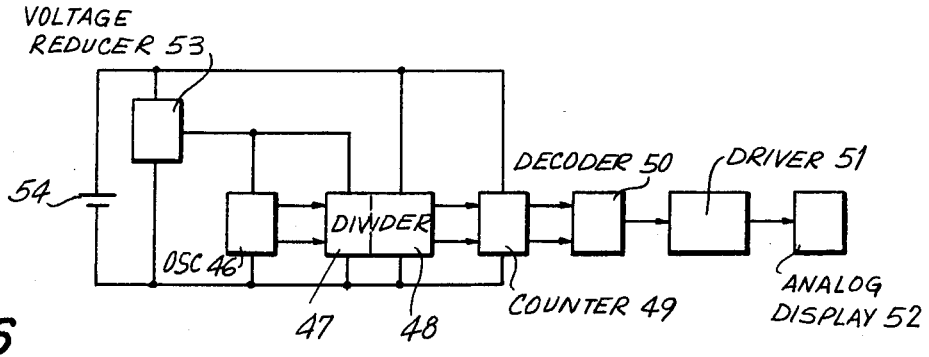
Figure 7:
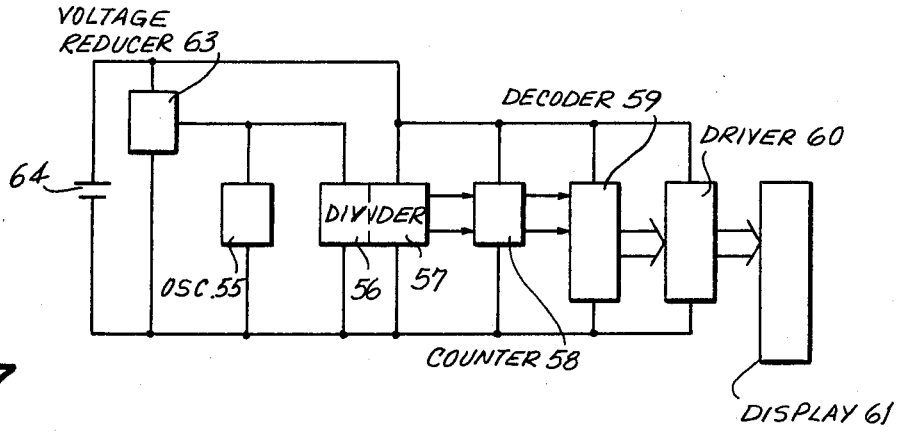

FIGS. 4 and 6 are functional block diagrams of electronic timepieces having an analog display, and FIGS. 5 and 7 are functional block diagrams of digital display type electronic timepieces. The analog timepieces include an electro-mechanical step motor, mechanical gear train and hands, whereas the digital timepieces include a liquid crystal or light emitting diode display.

In the analog display electronic timepiece of FIG. 4, a lithium battery 37 is connected to an oscillator 30, divider network 31, and driver 32 through a voltage reducing circuit 36 which serves to reduce the voltage applied to the respective circuit elements. The voltage is reduced from the 2.8 to 3.0 volts of the lithium battery 37 down to about 1.4 to 1.6 volts. Assuming, for example, that the efficiency of the voltage reducing circuit 36 is 100%, life of the battery 37 is increased to about twice the battery life in the embodiment where a lithium battery is applied directly to circuit elements, as illustrated in FIG. 1. When the capacity of a lithium battery is approximately three times as great as the capacity of a silver battery having the same physical dimensions, the battery life of the lithium battery is about three times as long. Accordingly, where a silver battery might operate for three years in a wrist watch using a conventional circuit of FIG. 1, a lithium battery utilizing the circuit of FIG. 4 would operate for about 9 years before replacement was required.

In FIG. 5 a lithium battery 45 is connected through a voltage reducing circuit 44 to drive an oscillator 38, divider 39, counter 40, decoder 41, and driver 42 for a digital display 43 of the depicted timepiece. Again, the output voltage of the lithium battery 45 is reduced by the voltage reducing circuit 44 from approximately 2.8 to 3.0 volts to approximately 1.4 to 1.6 volts. Ignoring the current drain of lamps frequently provided for illuminating digital displays, the battery life can be doubled in comparison with the prior art circuit incorporating a lithium battery as depicted in FIG. 3. The battery life is increased by more than three times as compared to the life of the silver battery illustrated in the timepiece of FIG. 2.

FIG. 6 depicts another embodiment of a timepiece having hands in an analog display 52. The timepiece is comprised of a standard frequency signal generating oscillator 46, a divider network 47, 48, a counter 49, a decoder 50, driver 51 and analog display 52 all performing functions as described above. The circuits are powered by a lithium battery 54 having a voltage of 2.8 to 3.0 volts which is reduced by a reducer circuit 53 to 1.4 to 1.6 volts for supply to the oscillator 46 and the upper stages 47 of the divider network 47, 48. Simultaneously, the lithium battery 54 provides 2.8 to 3.0 volts directly to the lower frequency stages 48 of the divider network 47, 48 and to the driver circuit 51 and counter 49 without voltage reduction.

In FIG. 7, a lithium battery 64 is applied through a reducing circuit 63 to indirectly power an oscillator 55 and higher frequency divider stages 56 of a divider network 56, 57. The lithium battery 64 is applied directly to power the lower frequency divider stages 57 of the divider network 56, 57, and also to a counter 58, decoder 59, and driver 60. As described above, the voltage reducing circuit 63 serves to reduce the voltage of the lithium battery 64 from a level of about 2.8 to 3.0 volts to a level of about 1.4 to 1.6 volts. Where the power consumption of a lamp provided in the timepiece is ignored, the life of a lithium battery connected as in the arrangement of FIG. 7 is about three times as long as the life of a silver battery connected as shown in FIG. 2, and about twice as long as a lithium battery connected as shown in FIG. 3.

In both embodiments, that is, FIGS. 6 and 7, the divider networks are segregated into two groups and each network is driven both by a reduced voltage and by the full battery voltage. The driving voltage can be selected in accordance with variations of circuit embodiments. In an alternative embodiment which is a variation of FIG. 6, the oscillator circuit and the divider circuit may be driven by a reduced voltage and the driver circuit may be driven by the full battery voltage. Alternative embodiments which are variations of the circuit of FIG. 7 are described as follows. An oscillator circuit and the divider network may be driven by a reduced voltage and the counter network, decoder, and driver circuits may be driven by the full battery voltage. In another variation, the oscillator circuit, divider network and the counter may be driven by a reduced voltage, and the decoder, and driver are driven by the full battery voltage. In yet another variation, the oscillator circuit, divider network, counter and driver are driven by the full battery voltage. Every embodiment contrives to reduce power consumption and current drain and lengthen the battery life by supplying a reduced battery voltage to all or a portion of the circuit of the electronic timepiece.

Circuitry for use in reducing battery voltage for application to the electronic timepieces in accordance with this invention are shown in FIGS. 8–13 and are described more fully hereinafter.

Figure 8:
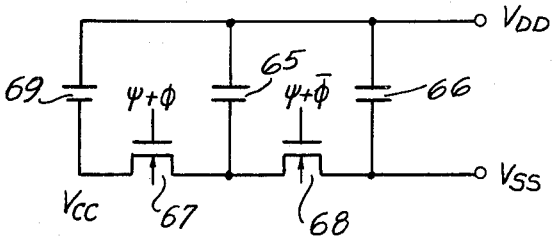
FIGS. 8–13 are circuit diagrams of embodiments of voltage reducing circuits in accordance with the invention.

FIG. 8 shows a voltage reducing circuit comprising capacitors 65, 66 and MOS transistor switches 67, 68. The capacitor 66 connects directly to the positive terminal of a lithium battery 69 and to the negative battery terminal through the source-drains of the transistors 67, 68. The capacitor 65 connects to the positive terminal of the battery 69 and to the junction between the transistors 67, 68. When a signal $\psi$ applied to the gates of the transistors 67, 68 is low, the switches 67, 68 are respectively opened and closed in a conventional manner. The reduced output of the circuit is taken across $V_{DD}$ and $V_{SS}$ which terminals are across the capacitor 66. When the switch 67 is turned on and the switch 68 is turned off, the capacitor 65 is charged to the full voltage of the lithium battery 69 through the transistors 67, 68. Then, when the switch 67 is turned off and switch 68 is turned on, the capacitor 65 discharges through the transistor 68 to charge the capacitor 66. A voltage of 1.4 to 1.6 volts across the terminals $V_{DD}$ and $V_{SS}$ can be achieved by selecting the capacity of the capacitor 65, 66. The capacities can be equal to effect a fifty percent voltage reduction.

Figure 9:
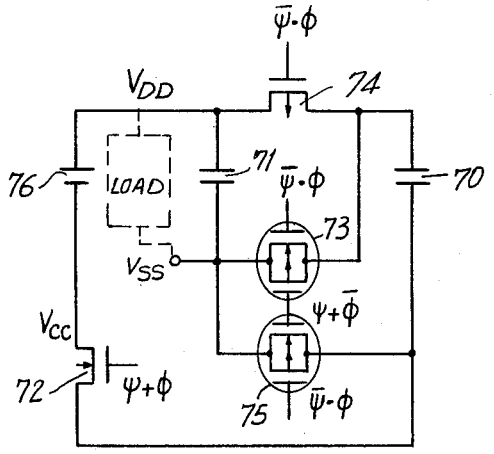

Another voltage reducing circuit as shown in FIG. 9 comprises capacitor elements 70, 71 of equal capacity and MOS transistor switches 72–75. When the signal $\psi$ is low, a pair of switches 72, 73 and a pair of switches 74, 75 are alternately changed on to off respectively. When the pair of switches 72, 73 turn on and the pair of switches 74, 75 are turned off, the capacitors 70, 71 are connected in series through the transistor 73 and are charged by the lithium battery 76. As a result, the voltage achieved across each capacitor 70, 71 is half of the 2.8 to 3.0 voltage of the lithium battery 76. When the pair of switches 72, 73 turn off and the pair of switches 74, 75 turn on, the capacitors 70, 71 are connected in parallel and a voltage of 1.4 to 1.5 volts is available at the terminals $V_{DD}$–$V_{SS}$. The capacitor 70 supplies current to a load connected across the terminals through the transistors 74, 75, and the capacitor 71 provides current directly to the reduced voltage terminals.

Figure 10:
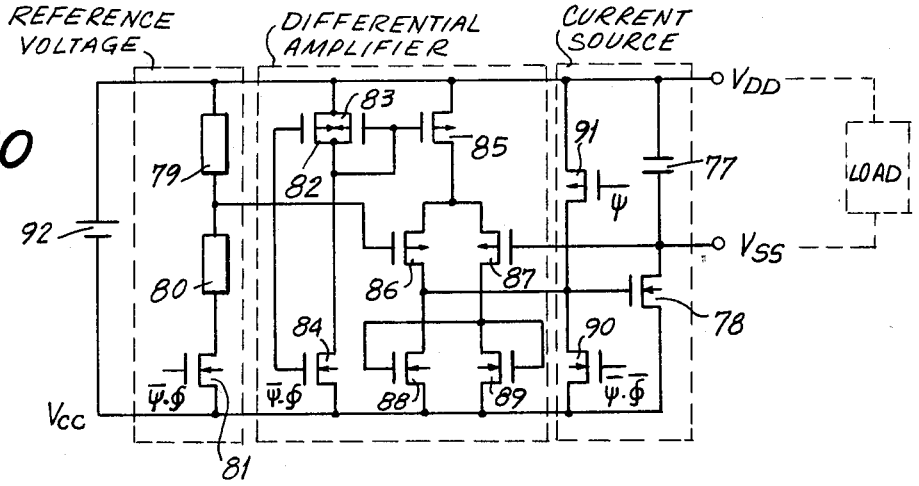

FIG. 10 shows another voltage reducing circuit for use in a timepiece in accordance with this invention. The voltage reducing circuit of FIG. 10 is comprised of a capacitor element 77, MOS transistors 78, 81–91, and voltage dividing element 79, 80. The voltage dividing elements 79, 80 are in series with the transistor 81 across the battery source 92, and the dividing elements 79, 80 comprise a voltage dividing circuit for the lithium battery 92. Coupled transistors 82, 83 are in series with transistor 84 across the battery source 92. Transistor 85 is in series with a series parallel arrangement of transistors 86, 88 and 87, 89 across the battery source 92. MOS transistors 82–89 form a differential amplifier. The gate of transistor 86 is connected to the junction between the voltage dividing elements 79, 80. The transistor 78 in series with the capacitor 77 and the parallel loop of transistors 90, 91 comprise a current source delivering its output across the terminals $V_{DD}$ and $V_{SS}$.

When the signal $\psi$ is low and the signal $\phi$ is high, each circuit portion of the reducing circuit is actuated. Namely, the voltage dividing circuit divides the battery voltage proportionately to the values of divider elements 79,80, and the differential amplifier controls so that the current source charges the capacitor 77 to a voltage equivalent to the divided voltage. In this circuit, by properly selecting the values of the divider elements 79, 80, a terminal voltage ($V_{DD}$—$V_{SS}$) of 1.4–1.6 volts is obtained. A pair of resistances, a pair of diodes, a pair of transistors or a pair of capacitors can be used to serve as the voltage divider element 79, 80. If resistances are used they may be formed by diffusion or ion implantation. If capacitors are used, an insulated film type capacitor is suitable. These divider elements can be sized to have substantially equal values if desired to have a 2:1 voltage reduction.

When the signal $\phi$ is low, each circuit portion of the voltage reducing circuit is not actuated and the MOS transistor 78 does not pass a current to charge the capacitor 77. As a result, the voltage stored in the capacitor 77 of 1.4 to 1.6 volts is gradually discharged through the connective circuit of the electronic timepiece (not shown in FIG. 10) or load.

Figure 11:
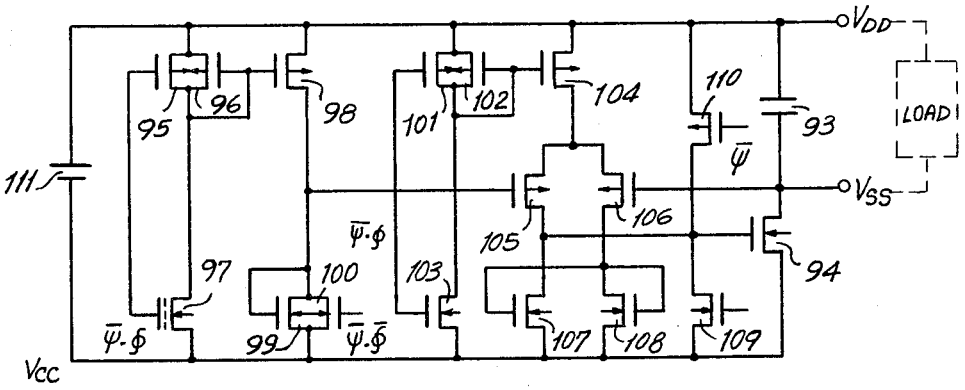

An alternative voltage reducing circuit shown in FIG. 11 is comprised of a capacitor element 93 and MOS transistors 94–110. MOS transistors 101–108 comprise a differential amplifier and MOS transistors 95–100 comprise a reference voltage source. MOS transistors 94, 109, 110 comprise an electric current source. These circuit portions in combination comprise a voltage reducing circuit in accordance with this invention. When the signal $\psi$ is low and the signal $\Phi$ is high, each circuit portion of the voltage reducing circuit is actuated. The reference voltage source 95–100 outputs the difference of the threshold voltages between the MOS transistors 97, 99 as a reference voltage. The differential amplifier 101–108 controls so that the electric current source 94, 109, 110 charges the capacitor 93 to the voltage equivalent to the reference voltage. In this circuit, by choosing the threshold voltages of transistors 97, 99, a terminal output voltage ($V_{DD}$ to $V_{SS}$) of 1.4 to 1.6 volts is obtained.

The difference in the threshold voltages of the transistors 97, 99 is a result of the shifted value of the threshold voltage of the individual transistors. The threshold is shifted by the value of the implanting charge on one of the channels 97, 99. This is accomplished by an ion implantation or channel doping technique. This difference in the threshold voltages can also be the result of a shift in value of a threshold voltage in accordance with the work function difference caused by a change of the gate material of either the transistor 97 or the transistor 99.

When the signal $\phi$ is low, each circuit portion of the voltage reducing circuit is not actuated and the transistor 94 flows no current such that the voltage stored in the capacitor 93, that is, 1.4–1.6 volts, is slowly discharged to supply the connected circuit for an electronic timepiece or other load.

Figure 12:
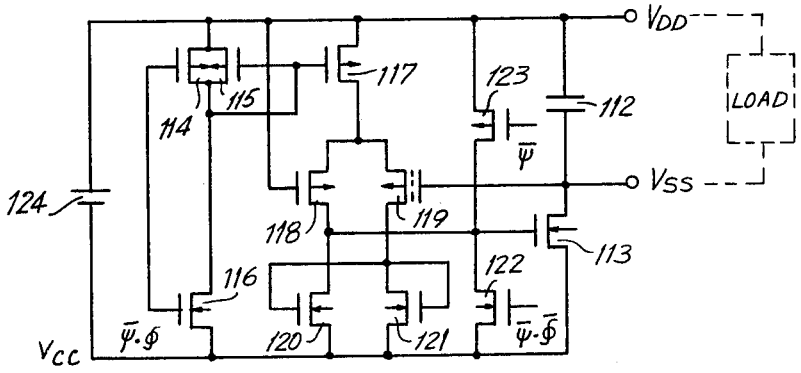

Another alternative circuit for a voltage reduction network is shown in FIG. 12 and comprised of a capacitor element 112 and MOS transistors 113–123. MOS transistors 114–121 comprise a differential amplifier having a reference offset voltage and MOS transistors 113, 122 and 123 comprise a current source. These transistors as a combination comprise a voltage reducing circuit in accordance with this invention. When the signal $\psi$ is low and the signal $\phi$ is high, each circuit portion of the reducing circuit is actuated. The differential amplifier uses the difference in the threshold voltages between a pair of difference input transistors 118, 119 as a reference offset voltage. The differential amplifier controls the current source so as to charge the capacitor 112 to a level equal to the offset voltage. A level of 1.4 to 1.6 volts at the output terminals ($V_{DD}$ to $V_{SS}$) is obtained by selecting the threshold voltages of the transistors 118, 119. Such a difference in the threshold voltages is achieved in the same way as described with reference to the embodiment of FIG. 12, namely, channel doping or a difference in gate material and work function.

When the signal $\Phi$ is low, each circuit portion of the voltage reducing circuit is not actuated, and MOS transistor 113 does not pass an electric current. As a result, the voltage stored in the capacitor 112 of 1.4 to 1.6 volts is gradually discharged to the connected circuit of an electronic timepiece (not shown) or other load.

Figure 13:
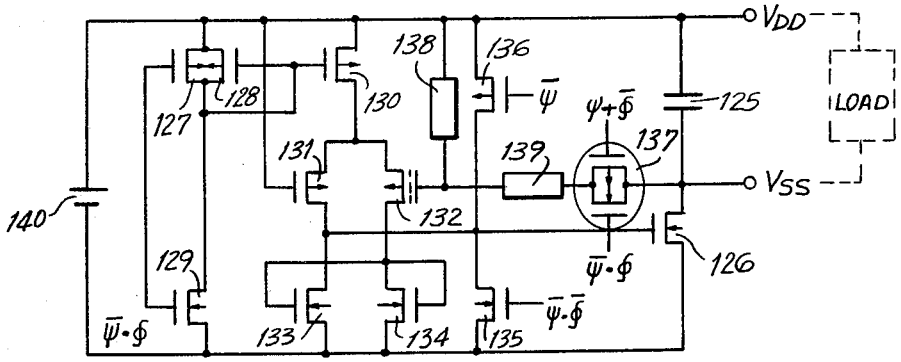

Yet another alternative circuit for voltage reduction is shown in FIG. 13 and is comprised of a capacitor 125, MOS transistors 126–136, a MOS transistor switch 137, and voltage dividing elements 138, 139. MOS transistors 127–134 comprise a differential amplifier having a reference offset voltage, and the MOS transistors 126, 135, 136 comprise a current source. The MOS transistor switch 137 and the voltage dividing elements 138, 139 form a voltage dividing circuit and these portions in combination form a voltage reducing circuit. When the signal $\psi$ is low and signal $\Phi$ is high, each circuit portion of the voltage reducing circuit is actuated. The differential amplifier operates on a difference in the threshold voltages between the pair of differential input transistors 131, 132 as a reference voltage. The differential amplifier aportions the voltage charge stored in the capacitor 125 in accordance with the values of the divider element 138, 139. The differential circuit voltage stored in the capacitor 125 by the current source is equivalent in value to the offset voltage. In this embodiment, by choosing the threshold voltages of the input transistors 131, 132 and the value of the divider elements 138, 139, the output terminal voltage ($V_{DD}$ to $V_{SS}$) in the range of 1.4 to 1.6 volts is obtained. The divider elements 138, 139 are formed in the same way as those described above in relation to FIG. 11, that is, by using, e.g., resistors, diodes, transistors, capacitors, and the difference in the threshold voltages is produced in the same manner as in the embodiment of FIG. 12, that is, by channel doping or different work functions. In particular, in modifying the work function as an example, in using a gate composed of polycrystalline silicon, the voltage reference elements can be made by changing the quantity of impurity included in the polycrystalline silicon or by changing the impurity type for another impurity type whose condictivity is different, and including this impurity type in the polycrystalline silicon.

When the signal $\Phi$ is low, each circuit of the voltage reducing circuit is not actuated and the MOS transistor 126 does not pass an electric current. As a result, the voltage stored in the capacitor 125 in the range of 1.4 to 1.6 volts is gradually discharged by the circuit of an electronic timepiece connected across the output terminals or to another load.

All of the embodiments of the voltage reducing circuit disclose that the voltage reducing circuit is comprised of a capacitor element and elements formed on a semi-conductor integrated circuits substrate whereon the circuit for the electronic timepiece is also formed. It is especially important that substantially all the circuit elements for voltage reduction are integrated on the MOS integrated circuit with the circuit for the electronic timepiece.

Figure 14:
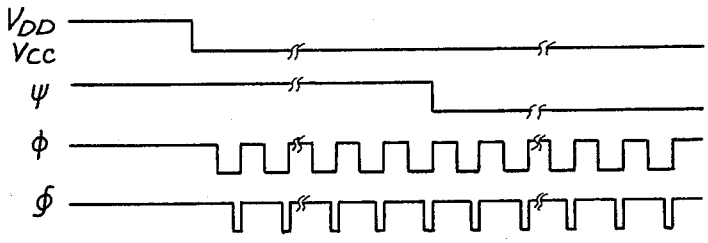
FIG. 14 shows timing waveforms associated with the circuits of FIGS. 8–13.

FIG. 14 shows timing charts of the signals $\psi$, $\phi$, and $\Phi$ for the embodiments of the voltage reducing circuits described above and shown in FIGS. 8–13. It should be understood that the signals $\bar{\psi}$, $\bar{\phi}$, and $\bar{\Phi}$ are signals having a reverse logic state as compared to the signals $\psi$, $\phi$, and $\Phi$. In the FIGS. a + sign indicates the logical sum of the two signals and the · indicates a logical product of the two signals. When a voltage is provided by inserting a battery, the signals $\phi$ and $\Phi$ are formed of the timing signals from the circuits for the electronic timepiece. The signal $\psi$ is high for some time, that is, several seconds to several minutes, after insertion of the battery. While the signal $\psi$ is high, the full battery voltage is applied to the circuits for the electronic timepiece. When the signal $\psi$ goes low, a voltage which is reduced by a voltage reducing circuit as described above is applied to selected circuits of the electronic timepiece. Because the characteristics of the oscillator circuit of the timepiece are not stable for a time period after insertion of the battery, the full battery voltage is applied at the outset and then reduced. In a liquid crystal display type electronic timepiece, a large quantity of current is consumed at the time of switching a driving lamp, alarm, buzzer, sound or voice device, and the like to an On condition. Therefore, at such times, there is a drop in the direct battery voltage as well as in the voltage which is reduced by the voltage reducing circuit. Then, actuation of the circuits for the electronic timepiece, for example, the oscillator circuit, becomes unstable. At such a time, a changed signal $\psi$ is utilized as a signal to supply the direct battery voltage to those circuits which otherwise would have the reduced battery voltage.

Figure 15:
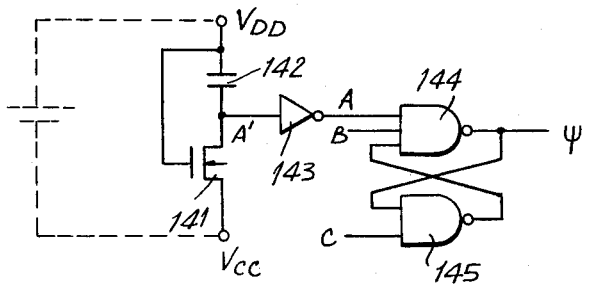
FIG. 15 is a generator circuit, generating a signal for the circuit embodiments of FIGS. 8–13.
Figure 16:
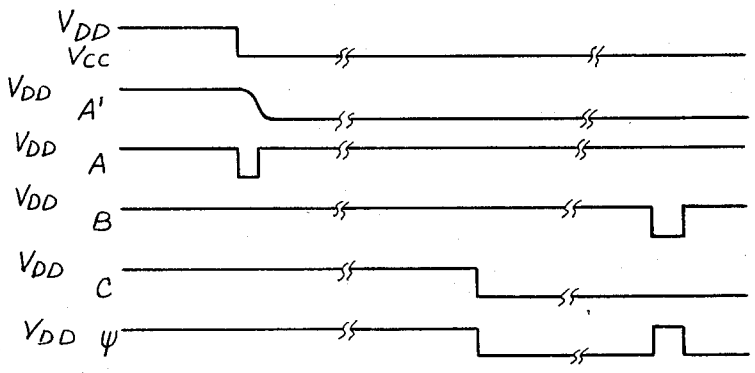
FIG. 16 is a timing chart for the circuit of FIG. 15.

FIG. 15 shows a circuit for generating a signal $\psi$ by which the direct battery voltage or a reduced battery voltage is selectively applied as the voltage for various circuits of an electronic timepiece. FIG. 15 is described with reference to FIG. 16 which shows a timing chart of the circuit of FIG. 16. In the circuit for generating the signal $\psi$, a capacitor 142 and MOS transistor 141 are in series between the terminals $V_{DD}$, $V_{CC}$ across which the battery will be applied. Before the battery is inserted, the electrical potential A' of the capacitor 142 is $V_{DD}$. When a battery, shown with broken lines in FIG. 15, is inserted, the MOS transistor 141 turns on and the potential A' becomes $V_{CC}$. A set-reset circuit, comprised of NAND gates is set by a signal A which is a reverse of the signal A' as a result of an inverter 143 located between the set-reset circuit and the junction between the capacitor 142 and transistor 141. Thus at the outset the signal A' is VDD; the Signal A is $V_{CC}$ and the output signal $\psi$ is $V_{DD}$. The potential of the signal $\psi$ is maintained at $V_{DD}$ until it switches to $V_{CC}$ as a result of the set-reset circuit being reset by a timing signal C derived from a circuit of the electronic timepiece. Operation of the voltage reducing circuits when $\psi$ is low has ben described above. When a switch D is set for a lamp, alarm, buzzer, etc. or the like which draws a high current, the signal $\psi$ equals $V_{DD}$ during the period that the signal from the switch B is $V_{CC}$. Thus at startup and during periods of heavy load the signal $\psi$ is at the level $V_{DD}$ where otherwise it will ba at a level $V_{CC}$.

Figure 17:
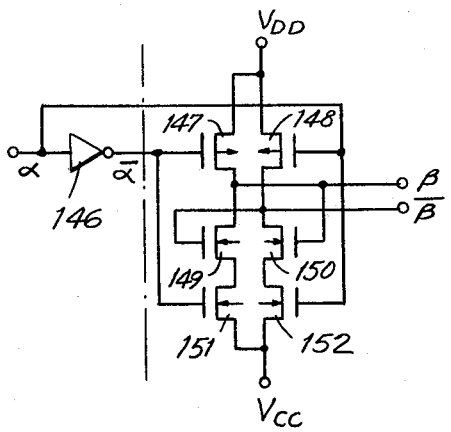
FIG. 17 is an interface circuit for transmission of signals from the reduced voltage network to the battery voltage network.

The signals applied to the circuit shown in FIG. 15 from the circuit for the electronic timepiece change the logical level through a proper interface circuit when the circuit for the electronic timepiece is driven by a reduced voltage. This interface circuit is also used to change the logical level in the signal transmission between the circuit portions in the electronic timepiece which are driven by a reduced voltage and the certain circuit portions in the electronic timepiece which are driven by a direct battery voltage. FIG. 17 shows such an interface circuit. Signals $\alpha$ and $\bar{\alpha}$ from the reduced voltage system ($V_{DD}$ minus $V_{SS}$) are changed into logical levels of the direct battery voltage system ($V_{DD}$ minus $V_{CC}$) to become signals $\beta$ and $\bar{\beta}$ respectively.

A voltage reducing circuit may be produced by various circuits other than the circuits of the embodiments shown in FIGS. 8–13. Such other circuits may include a capacitor, a resistance, a diode, a transistor or a circuit using transformers.

As stated above, by use of the voltage reducing circuits of this invention, it is possible to make effective use of a high output voltage battery with high density such as a lithium battery. As a result, the battery life can be extended to approximately three times the life of a silver battery as is used generally today. The life of a battery which is now two to three years will become six to nine years when using the circuits of this invention. This is almost equal to the average life of a wristwatch. Further, the external design will improve as the battery is made thin and small. As an example of this invention, the structure wherein the battery voltage of a lithium battery is reduced was described above, but this invention is effective for every type of battery. Moreover, the concept for reducing the battery voltage in use can be applied not only to an electronic timepiece but also to electronic calculators and general electronic devices using a battery as driving source.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A power circuit for an electronic wristwatch having a voltage source;

circuit means having a plurality of circuit elements, said circuit means operating from said voltage source, a portion of said circuit elements operating with an input voltage lower than the voltage of said voltage source, voltage reducing means connected intermediate said voltage source and said portion of said circuit elements operating at said reduced voltage, said voltage reducing means including:

a current source for storing and delivering power at reduced voltage to said portion of circuit elements, reference voltage circuit means having a reference voltage output level, and including a differential amplifier for controlling the voltage level by sensing said reference voltage and limiting the voltage of said current source in proportion to said reference voltage, one input to said differential amplifier being connected to one end of said portion of circuit elements.

2. A power circuit as claimed in claim 1 wherein said current source includes capacitor means, switch means having load terminals, said capacitor means being in series with said load terminals, said switch means being selectively opened and closed, said capacitor means being charged through said switch means when said switch means is closed.

3. A power circuit as claimed in claim 2, wherein said series connected capacitor means and switch means are connected across said voltage source, said reduced voltage output being taken between one terminal of said voltage source and a junction between said capacitor means and said switch means.

4. A power circuit as claimed in claims 1, 2 or 3, wherein said reference voltage circuit means includes a voltage divider comprising at least a pair of elements in a current path across said power source, said reference voltage circuit output being taken between a pair of said divider elements.

5. A power circuit as claimed in claim 4, wherein said divider elements are selected from the group including resistors, transistors, diodes and capacitors.

6. A power circuit as claimed in claim 1, 2, or 3, wherein said reference voltage circuit means includes a first and second transistor branch circuit across said power source, said reference voltage resulting from differences in transistor threshold voltages between each said branch.

7. A power circuit as claimed in claim 6, wherein:

said first branch comprises a transistor having its source connected to one terminal of said voltage source and its drain connected to the drain of coupled transistor, the source of said coupled transistor being connected to a second terminal of said voltage source;

said second branch comprising a transistor having its source connected to said second voltage source terminal and its drain connected to the drain of coupled transistor, the source of said coupled transistor being connected to said one terminal of said voltage source;

the gate of coupled transistor of said first branch being connected to the gate of said uncoupled transistor of said second branch, said gates being connected to the drain of said coupled transistor of said first branch;

said reference voltage being sensed at the source-drain junction of said second branch.

8. The power circuit as claimed in claim 6, wherein said threshold voltage difference between transistors is a result of ion implantation in the transistor channels.

9. The power circuit as claimed in claim 6, wherein said difference in transistor threshold voltages is a result of work function differences caused by changing the gate material of a portion of said transistors.

10. The power circuit as claimed in claim 1, 2 or 3, wherein said differential amplifier includes branch circuits, one branch of said differential amplifier is biased by the output voltage of said reference voltage circuit means and another branch of said differential amplifier is biased by the voltage at said junction between said capacitor means and switch means of said current source, said switch means being adapted to sense a balance in said differential amplifier branches and open said switch means when the voltage at said junction between said capacitor means and said switch means equals the voltage output of said reference voltage circuit means.

11. The power circuit as claimed in claim 10, wherein said differential amplifier circuit branches are comprised of series-parallel arrangements of MOS transistors.

12. The power circuit as claimed in claim 1, wherein all components of said power circuit are formed on an integrated circuit substrate, said substrate also having thereon the circuit for an electronic timepiece.

13. The power circuit as claimed in claim 2, wherein said power circuit, except said capacitor means, is formed on an integrated circuit substrate, said substrate also having the circuit for an electronic timepiece formed thereon.

14. The power circuit as claimed in claim 1, wherein said differential amplifier generates a reference offset voltage.

* * * * *